US006164233A

United States Patent [19]

Pollack et al.

[11] Patent Number: 6,164,233

[45] **Date of Patent: *Dec. 26, 2000**

[54] OFFSHORE TURRET WITH CIRCLE OF BEARING DEVICES

[75] Inventors: Jack Pollack, Camarillo; Peter Lunde, Westlake Village, both of Calif.; Rene Perratone, Menton, France

[73] Assignee: IMODCO, Inc.

[ * ] Notice: This patent is subject to a terminal disclaimer.

[21] Appl. No.: 09/370,052

[22] Filed: Aug. 6, 1999

Related U.S. Application Data

[63] Continuation-in-part of application No. 08/911,924, Aug. 15, 1997, Pat. No. 5,957,076.

[51] Int. Cl.[7] ..... B63B 21/00

[52] U.S. Cl. ..... 114/230.12

[58] Field of Search ..... 114/230.1, 230.12

[56] References Cited

U.S. PATENT DOCUMENTS

| | | | |
|---|---|---|---|
| 4,601,252 | 7/1986 | Wuttudal | 441/3 |
| 4,753,553 | 6/1988 | Carlsen et al. | 114/230 |
| 5,515,804 | 5/1996 | Pollack . | |
| 5,957,076 | 9/1999 | Pollock et al. | 114/230.12 |

*Primary Examiner*—Sherman Basinger
*Attorney, Agent, or Firm*—Leon D. Rosen

[57] ABSTRACT

An offshore system is described, of the type that includes a turret (20) anchored to the sea floor and connected by at least an upper bearing assembly (34) to the vessel hull (14) so the hull can weathervane about the turret, wherein the upper bearing assembly is of moderate cost and high reliability, is easily maintained, and accommodates vessel hull deformation. The upper bearing assembly includes a circle of bearing devices(202) wherein each device includes a cylinder (224) and piston (226). A source (260) of pressured fluid is applied to the devices to push apart the cylinder and piston to support an upper bearing part (204) of the turret on a lower bearing part (210) of the hull.

14 Claims, 3 Drawing Sheets

FIG. 4
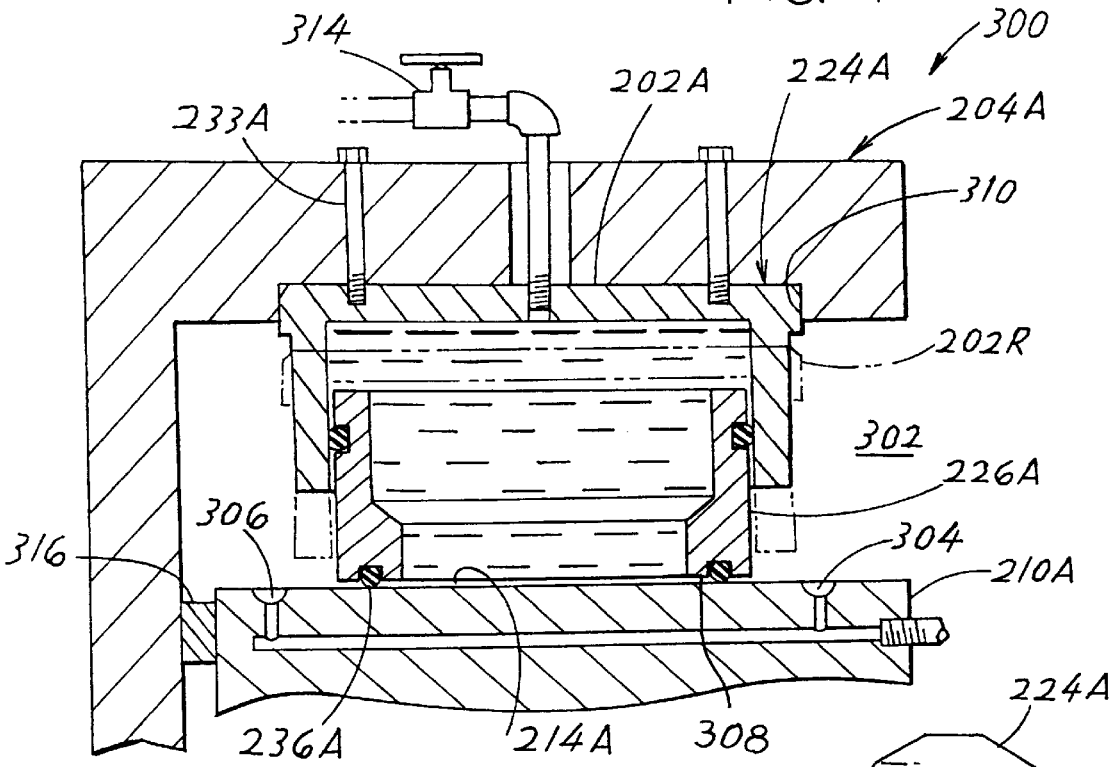
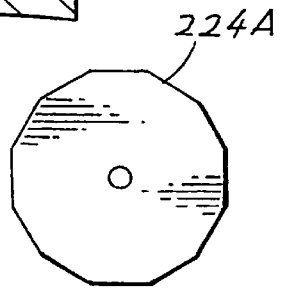
FIG. 5
FIG. 6
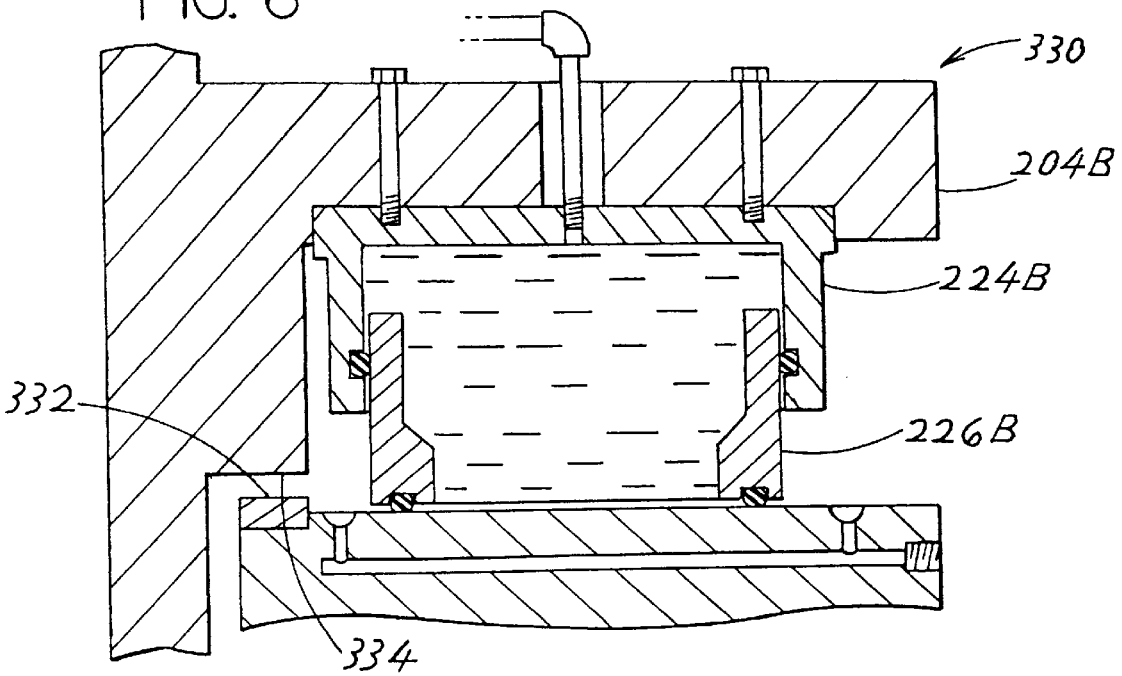

OFFSHORE TURRET WITH CIRCLE OF BEARING DEVICES

CROSS-REFERENCE TO RELATED APPLICATION

This is a continuation-in-part of the U.S. application Ser. No. 08/911,924 filed Aug. 15, 1997, now U.S. Pat. No. 5,957,076.

BACKGROUND OF THE INVENTION

One type of offshore system includes a turret that lies in a moonpool of a vessel hull, or outboard of the hull, and a bearing structure that allows the vessel to weathervane (rotate without limit about a vertical axis) around the turret. The turret is anchored to the seafloor and fluid lines usually extend from wells or pipelines at the seafloor up to the turret. The bearing structure includes an upper bearing assembly and sometimes a lower bearing assembly. The upper bearing assembly supports the weight of the turret and the weight of the mooring structure and hoses attached thereto, which may amount to thousands of tons.

The upper bearing assembly has previously been a roller bearing, which has low friction so the turret will turn only a few degrees before the rollers roll. However, there are serious disadvantages in the use of roller bearings. One disadvantage is that reliable roller bearings require raceways that are forged before machining, to provide strength to resist the concentrated forces of individual rollers. Forging equipment is not always readily available, especially in large sizes such as for raceways of a diameter of about eight meters or more. Some large turrets have diameters of up to twenty meters. The cost for large roller bearings is high and they cannot be repaired in operation. An upper bearing structure for supporting the weight of a turret on a vessel hull, which avoided the above disadvantages, especially for large turrets of a diameter of about eight meters or more, would be of value.

SUMMARY OF THE INVENTION

In accordance with one embodiment of the present invention, an upper bearing assembly is provided for supporting a turret on a vessel hull, which can be constructed in large diameters, which can be constructed at lower cost than roller bearings, and which can be maintained and repaired in operation. The upper bearing assembly includes upper and lower ring-shaped bearing parts, one on the turret and the other on the hull. A plurality of bearing devices lie along a ring-shaped path between the upper and lower bearing parts to support the turret on the hull. Each bearing device includes a cylinder and piston. A source of pressured fluid is coupled to each device, to press the cylinder and piston apart, as by pipes that extend through holes in a bearing part. Each device has a width at least as great as its height, to provide stable support However, each cylinder can tilt by at least 0.5 degree with respect to its piston to continue to provide support for the turret even if the hull is distorted. The force of the piston against a bearing surface is taken primarily by the pressured fluid.

In one assembly, the region between the upper and lower bearing parts is substantially unobstructed outside the circle of bearing devices. A single one of the bearing devices can be replaced by stopping the flow of pressured fluid to it, so the cylinder drops (or the others are raised) and can be removed through the unobstructed space. A face bearing can support the turret on the hull in the event of pressure failure.

The novel features of the invention are set forth with particularity in the appended claims. The invention will be best understood from the following description when read in conjunction with the accompanying drawings.

BRIEF DESCRIPTION OF THE DRAWINGS

FIG. 4 is a partial sectional view of an upper bearing assembly of another embodiment of the invention.

FIG. 5 is a plan view of the bearing device of FIG. 4.

FIG. 6 is a partial sectional view of an upper bearing assembly of another embodiment of the invention.

DESCRIPTION OF THE PREFERRED EMBODIMENTS

Figure 1:
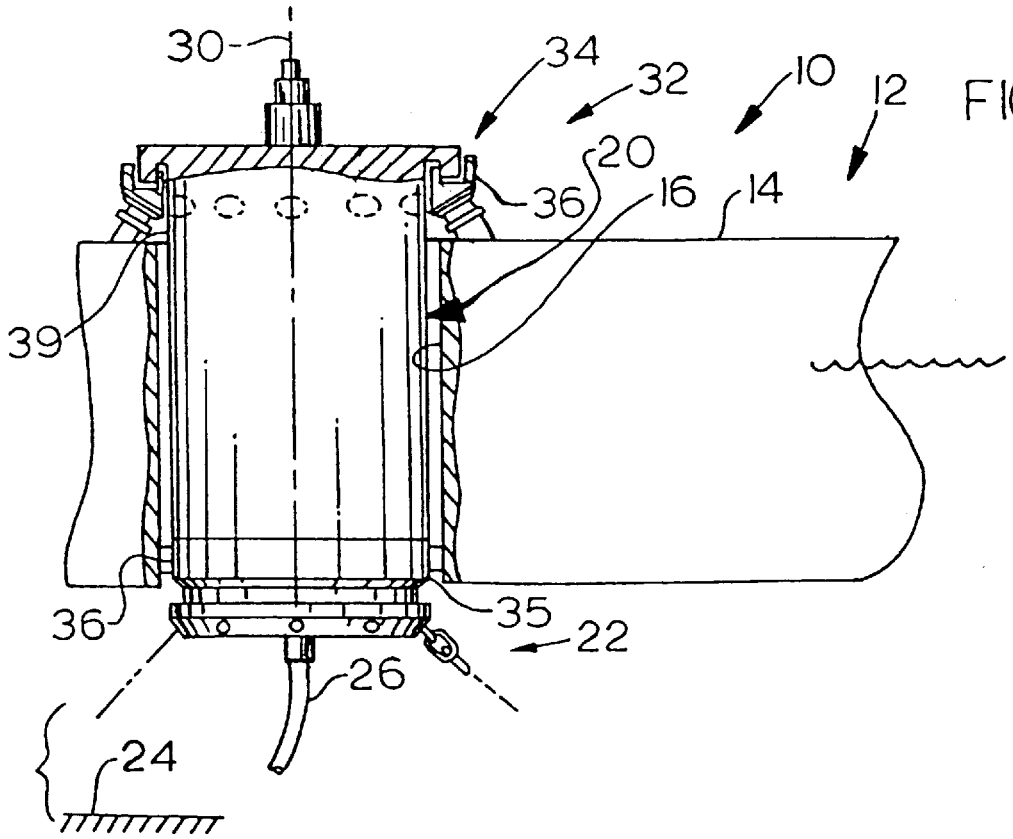
FIG. 1 is a partial sectional view of an offshore system constructed in accordance with the present invention.

FIG. 1 illustrates an offshore system 10 which includes a vessel 12 having a hull 14 with a vertical opening or moonpool 16 that receives a turret 20. A mooring structure 22 extends from the turret to the seafloor 24, and limits drift of the vessel. The mooring structure illustrated, includes several long mooring lines in the form of heavy chains that extend in catenary curves to the seafloor and along it, although vertical risers and other mooring structures are available. A fluid conduit 26 extends from a seafloor well or seafloor pipeline up to the turret. The hull 14 can weathervane, that is, rotate without limit about a vertical axis 30 with changing winds and currents. However, the turret 20 is largely non-rotatable, in that it cannot rotate without limit, and usually does not rotate more than perhaps 10°.

A bearing structure 32 that rotatably connects the turret to the hull, includes upper and lower bearing assemblies 34, 36. The upper bearing assembly 34 usually supports most or all of the vertical weight of the turret and loads thereon. Where the turret has a large height, as is shown in FIG. 1, so a lower portion 35 of the turret lies near the hull bottom, a lower bearing assembly 36 is provided and usually takes most of the radial load, that is, the horizontal component of the load from one of the chains when the vessel drifts in a direction to increase tension in that chain. However, it is usually necessary to provide some radial bearing capability at the upper bearing assembly 34. In severe weather, the turret and/or hull may deform, which may cause tilt of the upper portion 39 of the turret. In roller bearing assemblies, tilt has been avoided by providing upper and lower sets of rollers, although this further adds to the cost of roller bearings.

Figure 2:
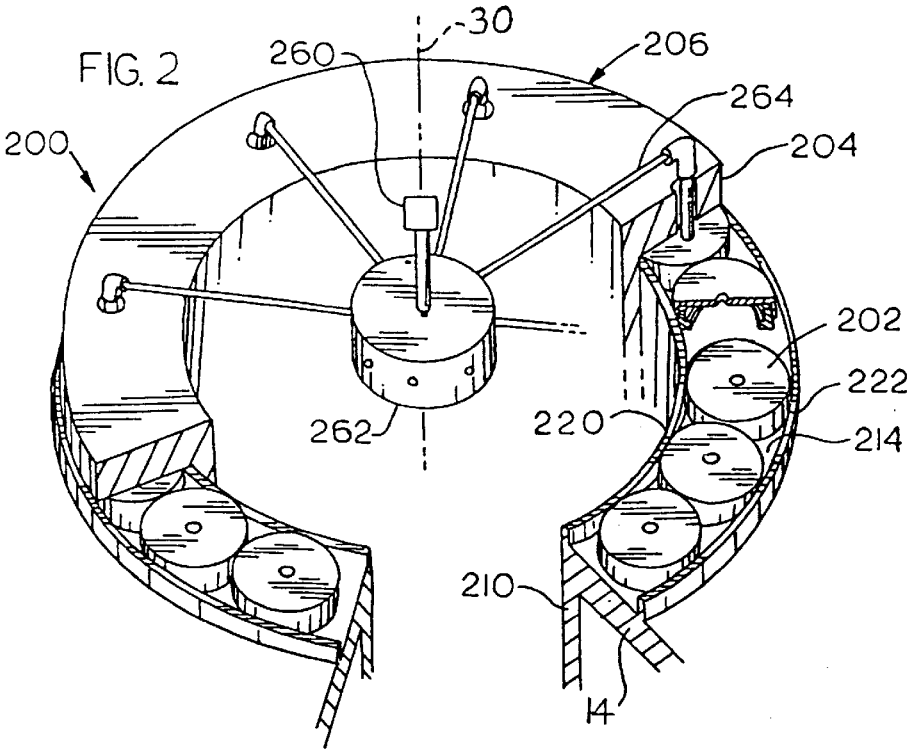
FIG. 2 is a partial isometric view of an upper bearing assembly that can be used in the system of FIG. 1.

FIG. 2 illustrates an upper bearing assembly 200 which includes a group of bearing devices 202. The bearing devices support an upper bearing part 204 of the turret 206 on a lower bearing part 210 of the vessel hull 14. The devices 202 are confined to a circular track 214 that is concentric with the turret axis of rotation 30. The track is formed by inner and outer track walls 220, 222 of the hull. The upper element can be fixed to the upper bearing part 206 by bolts, so the track walls only retain lubricant.

Figure 3:
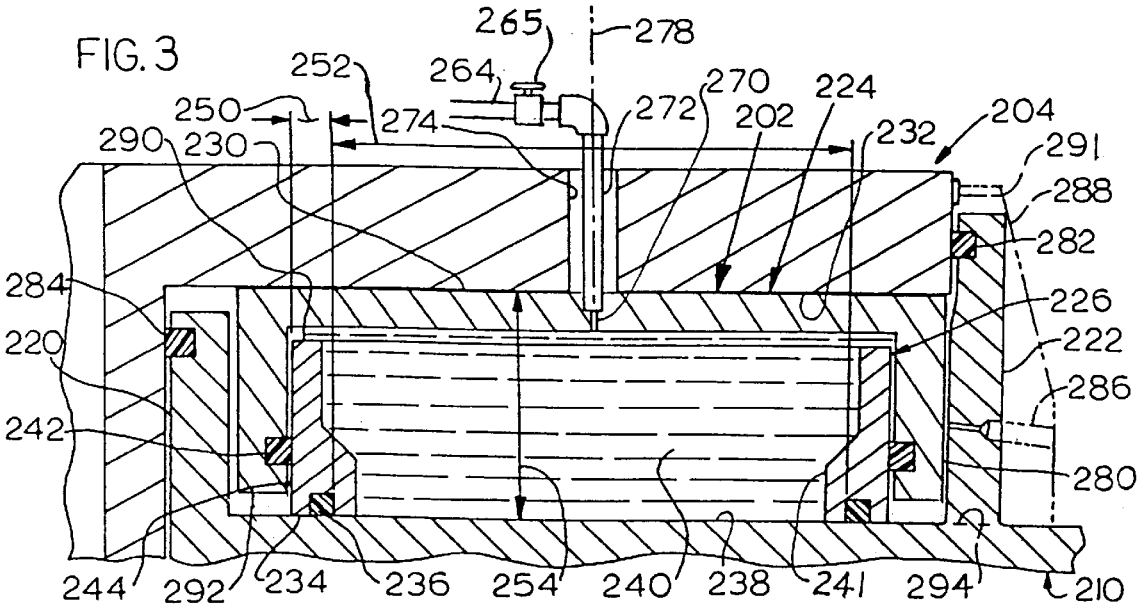
FIG. 3 is a sectional view of one of the bearing devices of the assembly of FIG. 2.

FIG. 3 shows that each bearing device 202 includes upper and lower elements 224, 226. The upper element has an upper face 230 that bears against an upper bearing surface 232 of the turret bearing part. The lower element lies within the upper one. The lower element has a lower face 234 that bears (at least at its seal 236) against a lower bearing surface 238 of the hull lower bearing part. Lower element 226 has an opening which leads to lower bearing surface 238 and has a peripheral portion around the opening which is sealed against the lower bearing surface 238 by seal 236. The opening in lower element 226 occupies a majority of the area within the sealed peripheral portion. A pressured fluid (e.g. 100 psi) 240 such as oil lies in a plenum 241 within the device 202 and pushes the elements apart. It is possible to turn the bearing devices upside down so the bearing devices slide along the upper element face, which facilitates locating the pressure source on the vessel hull. A shown in FIGS. 2 and 3, the bearing devices 202 each occupy a majority of the vertical distance between upper bearing surface 232 and lower bearing surface 238 at the locations of the bearing devices 202 and between adjacent ones of the bearing devices 202.

A medium pressure face seal 236 seals the lower face 234 of the lower element to the lower bearing surface 238. A medium-pressure radial seal 242 seals the gap 244 between the outside of the lower element and the inside of upper one. This results in the pressured fluid 240 being trapped between the elements and pushing the upper element up while pushing the lower element down. The downward force on the lower element is equal to the pressure of the fluid times the area within the ring-shaped region 250. The pressured fluid pushes directly against the lower bearing surface 238 over a circle of diameter 252. It can be seen from FIG. 3 that the diameter (252+2×250) of the bearing device (at the outside of the piston element 226) is greater than its height 254. The diameter of the bearing device at the outside of the cylinder element 224 is greater than its height.

The elements 224, 226 act like a cylinder (not necessarily of cylindrical shape) and piston, so the upper element can move up or down by a moderate amount such as up to two centimeters. The gap 244 is large enough that the upper element can tilt by more than ¼ degree and preferably at least 0.5 degrees, and more preferably by over one degree (most pistons can tilt by less than ¼ degree within their cylinders). As a result, if the turret and/or hull deform in severe weather so the distance 254 between bearing surfaces 232, 238 changes by a small amount or they tilt away from parallelism, the bearing devices can still support the turret on the hull. Such a warp would commonly result in the distance 254 for bearing devices at one side of the turret axis increasing while the distance for bearing devices on the opposite side decreased. Also, each upper element would tilt slightly with respect to its lower element. In one example, the outer diameter of each bearing device is one meter.

FIG. 2 shows a source 260 of pressured fluid (e.g. hydraulic fluid) connected through a manifold 262 to fluid conduits 264 that each extends to one of the bearing devices 202 and that each has a shutoff valve 265 (FIG. 3). Only every other bearing device receives pressured oil and supports the turret with the others useful as spares. Of course, it is possible to use none or only a few bearing devices as spares, and a spare can be connected through a shutoff valve to the source of pressured oil. It is desirable to use spares evenly distributed about the circle of bearing devices (e.g. two on diametrically opposite sides of the axis) to avoid imbalances. FIG. 3 shows a hole 270 in the upper element and a pipe 272 of the conduit that is coupled to the hole 270 and that extends through a hole 274 in the turret bearing part 204. The upper end of the pipe is connected to a pipe that extends from the manifold. The bearing device 202 moves with the turret as the turret rotates. The bearing device is preferably fixed in rotation and position on the turret bearing part by bolts. The source 260 can be constructed to maintain a low or zero pressure until a sensor senses torque along the turret that indicates perhaps a 5° rotation. Then the pressure is increased to operating pressure. Initially, the pressure can be made to fluctuate to help the beginning of turret rotation.

When the turret turns (e.g. by 10's of degrees) the outer walls 280 of the upper, or outer element 224 do not have to slide along the track walls 220, 222 if the upper element is fixed to the upper, or turret, bearing part. Lubricating oil at near zero pressure is maintained therein to minimize friction. Low pressure seals 282, 284 avoid spillage if the vessel tilts, and a gravity pipe 286 can return excess oil to a reservoir. FIG. 3 shows, in phantom lines, an extension 288 of the outer wall carrying a radial bearing 291 that keeps the upper end of the turret centered on its axis.

One way to operate the system of FIG. 3 is to maintain a volume of fluid in the bearing devices 202 so the upper element lies a predetermined distance above the lower one, as shown in FIG. 3. Check valves can maintain the height of the upper element despite load changes. It is also possible to operate the system with the pressure of oil set to be slightly less than that required to keep the upper element 224 above the top surface 290 of the lower element. In either way of operation, the lower faces 234 of the lower elements are formed of a low friction material to permit turret rotation if fluid pressure fails; the oil coating on surface 238 will maintain moderately low friction. A door 294 is provided to enable replacement of a damaged bearing device, although spares are already present. Since a door can be readily opened (it can be opened within 15 minutes), the space lying radially outside the circle of bearing devices is considered substantially unobstructed.

A damaged bearing device 202 can be replaced by increasing the pressure on all bearing devices in use, except for the selected one to be replaced. This lifts the upper elements 224 except for the upper element of the selected bearing device. A valve 265 lying along the fluid conduit 264 leading through a pipe 272 to the bearing device to be replaced, is closed, and the pipe 272 is removed from the upper element 224. Any bolts holding the upper element to the upper bearing part 204 are loosened and the upper element is allowed to drop onto the lower element. Then, the bearing device is slid out through the door 294. The door 294 provides an unobstructed bearing replacement space lying radially outside the circle of bearing devices (when the door is opened, which can be readily accomplished). During such replacement the turret continues to be supported and can rotate. Since rotation is slow, a door 294 of only moderately greater width than one bearing device is sufficient.

FIG. 4 illustrates another system 300 where a circle of bearing devices 202A support an upper bearing part 204A of the turret on a lower bearing part 210A of the vessel hull. The upper element 224A of each bearing device is fixed to the upper bearing part, while the lower element 226A slides along a circular track 214A. An unobstructed space 302 lies radially outside the bearing devices. Oil leaking out through the seal 236A lubricates the track, and excess oil is captured in recess 304, 306 that extend in circles. Instead of the O-ring seal at 236A, it is possible to provide a coating of PTFE on the surface 308 that slides on the track, or to attach a block of that material, since about 90% of more of the vertical load is taken by oil pressure.

The top of the upper element has a 12-sided periphery, as shown in FIG. 5, and fits into a recess 310 having twelve (or four) sides, to prevent rotation of the upper element on the upper bearing part. Bolts 233A are also used. Replacement of a bearing device is accomplished in the same manner as for the system of FIG. 3, with a shut-off valve 314 being shown. The lowered upper element is indicated at 202R. No door has to be opened for replacement. FIG. 4 shows a radial bearing 316 lying radially inside the circle of bearing devices to avoid obstruction.

FIG. 6 shows a system 330 similar to that of FIG. 4, but with a back-up bearing 332. If oil pressure cannot be maintained, a slider surface 334 on the upper bearing part 204B can rest on the back-up bearing. The back-up bearing is formed of a high pressure capacity, low friction material such as XYTREX. The turret can still turn, although with a much higher friction, but with the coefficient of friction between the bearing part and slider surface being still less than 0.05. When the oil pressure drops to zero, the upper element 224B still does not rest on the lower element 226B.

Thus, the invention provides an upper bearing assembly for supporting a turret on a vessel hull, which can be constructed to be reliable in very large sizes, and at moderate cost. In one assembly a plurality of bearing devices each has upper and lower elements (that are not necessarily separately formed) that are biased apart by pressured fluid, so the bearing devices support the turret on the vessel hull. The devices are preferably at least as large in diameter as in height for stability. The upper and lower elements of each bearing device preferably can tilt at least about 0.5° with respect to each other about horizontal axes to accommodate vessel hull deformation. Upper elements of the devices are preferably rigidly fixed to the upper bearing part. The region outside the circle of bearing devices (they can lie on more than one circle) is substantially unobstructed to permit rapid removal of a bearing device.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearing parts that have bearing surfaces that substantially face each other, with the upper bearing part connected to said turret and the lower bearing part connected to said hull;

a plurality of individual bearing devices that lie between said upper and lower bearing surfaces, with each bearing device having upper and lower elements with upper and lower faces lying respectively against said upper and lower bearing surfaces, with said elements being slidable with respect to at least one of said bearing surfaces, and with said upper and lower elements being biased apart but being largely vertically moveable relative to each other;

each of said bearing devices has a diameter at least as great as its height as measured between said upper and lower faces, with said bearing devices each occupying a majority of the vertical distance between said bearing surfaces of said upper and lower parts, at the locations of said bearing devices and between adjacent ones of said bearing devices.

2. The system described in claim 1 wherein:

one of said elements forms a cylinder and the other forms a piston with a portion lying within said cylinder and including a radial seal that seals an outside of said piston to an inside of said cylinder, with there being a sufficient clearance between said outside of said piston and said inside of said cylinder that said upper and lower elements of each of said bearing devices can tilt by at least 0.5 degree with respect to each other, to enable said vessel hull to deform while still supporting said turret in low friction rotation.

3. The system described in claim 1 wherein:

said lower bearing part has concentric inner and outer track walls that form a circular track between them, with said bearing devices lying between said track walls, and with lubricant lying on said lower bearing surface and confined between said track walls.

4. The system described in claim 1 wherein:

said elements form a cavity between them, and including means for applying pressured fluid to said cavity to bias said elements apart;

a first of said elements forms a piston and a second of said elements forms a cylinder that surrounds at least a portion of said piston, with one of said elements having a radial seal that seals to the other of said elements as said piston moves vertically with respect to said cylinder, and with said piston having an opening leading to a corresponding one of said bearing surfaces and having a peripheral portion around said opening which is sealed against said corresponding bearing surface, and with said opening occupying a majority of the area within said sealed peripheral portion.

5. The system described in claim 1 wherein:

said bearing devices lie in a ring, and including at least one bearing device spare lying in said ring and between said upper and lower bearing parts and having upper and lower elements that are not biased apart to support said upper bearing part on said lower bearing part, to form a spare to replace one of said bearing devices without having to move the spare into place between said upper and lower bearing parts.

6. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearing parts that have bearing surfaces that substantially face each other, with the upper bearing part connected to said turret and the lower bearing part connected to said hull;

a plurality of individual bearing devices that lie between said upper and lower bearing surfaces, with each device having upper and lower elements with upper and lower faces lying respectively against said upper and lower bearing surfaces, with said elements being slidable with respect to at least one of said bearing surfaces, and with said upper and lower elements being biased apart and being largely vertically moveable relative to each other;

each of said upper elements is fixed to said upper bearing part but each of said upper elements can tilt about horizontal axes by more than one-quarter degree with respect to the corresponding lower element, to enable said vessel hull to deform while still supporting said turret in low friction rotation.

7. The offshore system described in claim 6 wherein:

one of said elements forms a piston and the other forms a cylinder, with a portion of said piston lying with said cylinder and radially sealed to said cylinder during largely vertical movement of said piston relative to said cylinder.

8. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearing parts that have bearing surfaces that substantially face each other, with the upper bearing part connected to said turret and the lower bearing part connected to said hull;

a plurality of individual bearing devices that lie between said upper and lower bearing surfaces, with each device having upper and lower elements with upper and lower faces lying respectively against said upper and lower bearing surfaces, with said elements being slidable with respect to at least one of said bearing surfaces, and with said upper and lower elements forming a plenum between them for receiving pressured fluid to bias them apart and being vertically moveable relative to each other;

a plurality of fluid conduits that each couples a source of pressured fluid to a plenum of a selected one of said bearing devices, with a first of said upper and lower bearing parts having a plurality of holes and with each conduit coupled through one of said holes to a selected element of one of said bearing devices.

9. The system described in claim 8 including:

a plurality of fasteners that each rigidly fixes one of said selected elements to said first bearing part.

10. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearing parts that have bearing surfaces that substantially face each other, with the upper bearing part connected to said turret and the lower bearing part connected to said hull;

a circle of individual bearing devices that lie between said upper and lower bearing surfaces, with each device having upper and lower elements with upper and lower faces lying respectively against said upper and lower bearing surfaces, with said elements being slidable with respect to at least one of said bearing surfaces, and with said upper and lower elements forming a plenum between them for receiving pressured fluid to bias them apart and being vertically moveable relative to each other;

a face bearing of low friction material mounted on one of said bearing parts, with the other bearing part forming a slider surface lying vertically opposite said face bearing, with the distance between said face bearing and said slider surface chosen so they engage each other when zero pressure lies in the plenums of said bearing devices.

11. A method for supporting a turret that has an upper bearing part with an upper bearing surface, on a hull that has a lower bearing part with a lower bearing surface, with said bearing surfaces substantially facing each other, comprising:

establishing a circle of quantities of pressured oil that each has upper and lower ends and a predetermined area as viewed in a downward direction, between said bearing surfaces, allowing a majority of said area of a first end of each quantity to push directly against a first of said bearing surfaces while confining a periphery of said first end of said quantity by a first element that can slide along said first surface and fixing a second end of each quantity to a second of said bearing surfaces.

12. The method described in claim 11 including:

said step of fixing a second end includes confining said second end of each quantity by a second element that is fixed to said second bearing part and that can slide vertically with respect to a corresponding one of said first elements, while providing a radial seal between said elements.

13. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearing parts that have bearing surfaces that substantially face each other, with the upper bearing part connected to said turret and the lower bearing part connected to said hull;

a plurality of individual bearing devices that lie between said upper and lower bearing surfaces, with each bearing device having upper and lower elements with upper and lower faces lying respectively against said upper and lower bearing parts, with said elements being slidable with respect to at least one of said bearing surfaces, and with said upper and lower elements being biased apart but being largely vertically moveable relative to each other;

one of said elements forms a cylinder and the other forms a piston with a portion lying within said cylinder, said piston forming a plenum, with said piston having an outside radially sealed to an inside of said cylinder, with there being a sufficient clearance between said outside of said piston and said inside of said cylinder that said upper and lower elements of each of said bearing devices can tilt by at least 0.5 degree with respect to each other.

14. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearing parts that have bearing surfaces that substantially face each other, with the upper bearing part connected to said turret and the lower bearing part connected to said hull;

a plurality of individual bearing devices that lie between said upper and lower bearing surfaces, with each bearing device having upper and lower elements with upper and lower faces lying respectively against said upper and lower bearing parts, with said elements being slidable with respect to at least one of said bearing surfaces, and with said upper and lower elements being biased apart but being largely vertically moveable relative to each other;

said elements form a cavity between them containing pressured fluid;

a first of said elements forms a piston and a second of said elements forms a cylinder that surrounds at least a portion of said piston, with an outside of said piston being radially sealed to an inside of said cylinder as said piston moves vertically with respect to said cylinder, and with said piston having an opening leading to a corresponding one of said bearing surfaces, and with said piston having a peripheral portion sealed against said corresponding bearing surface, with said opening occupying a majority of the area within said peripheral portion and with said cavity extending through said opening.

* * * * *